US009989301B2

(12) United States Patent
Foege

(10) Patent No.: US 9,989,301 B2
(45) Date of Patent: Jun. 5, 2018

(54) SYSTEM AND METHOD FOR CONTROLLING FLOW OF FLUID

(71) Applicant: Electro-Motive Diesel, Inc., LaGrange, IL (US)

(72) Inventor: Aaron Gamache Foege, Westmont, IL (US)

(73) Assignee: Progress Rail Locomotive Inc., LaGrange, IL (US)

( * ) Notice: Subject to any disclaimer, the term of this patent is extended or adjusted under 35 U.S.C. 154(b) by 260 days.

(21) Appl. No.: 15/075,469

(22) Filed: Mar. 21, 2016

(65) Prior Publication Data

US 2017/0268817 A1 Sep. 21, 2017

(51) Int. Cl.
*F17C 13/02* (2006.01)
*F25D 29/00* (2006.01)
*F25D 3/10* (2006.01)

(52) U.S. Cl.
CPC ..... *F25D 29/001* (2013.01); *F25D 3/10* (2013.01)

(58) Field of Classification Search
CPC ..... F25D 29/001; F25D 3/10; F25D 29/00
USPC ..... 62/49.1, 48.1, 50.2
See application file for complete search history.

(56) References Cited

U.S. PATENT DOCUMENTS

| | | | | |
|---|---|---|---|---|
| 5,477,691 | A | 12/1995 | White | |
| 7,054,764 | B2 | 5/2006 | Williams et al. | |
| 7,255,013 | B2 | 8/2007 | Urbahn et al. | |
| 8,474,273 | B2 | 7/2013 | Gibson | |
| 8,695,357 | B2 | 4/2014 | Brook et al. | |
| 2014/0150469 | A1 | 6/2014 | Drube et al. | |
| 2014/0250921 | A1* | 9/2014 | Kang | B63H 21/38 62/49.1 |

* cited by examiner

*Primary Examiner* — Len Tran
*Assistant Examiner* — Ana Vazquez

(57) ABSTRACT

A flow control system for a flow of a cryogenic fluid over a component is provided. The system includes a first tubing containing a first fluid therein and positioned upstream of the component with respect to the flow of the cryogenic fluid. The system includes a second tubing containing a second fluid therein and positioned downstream of the component with respect to the flow of the cryogenic fluid. The system also includes a parameter sensing device fluidly connected to the first tubing and the second tubing for comparing a first parameter associated with the first tubing and a second parameter associated with the second tubing. The system further includes a flow control device coupled to the parameter sensing device to regulate the flow of the cryogenic fluid over the component based, at least in part, on the comparison.

20 Claims, 3 Drawing Sheets

SYSTEM AND METHOD FOR CONTROLLING FLOW OF FLUID

TECHNICAL FIELD

The present disclosure relates to a system and a method for controlling a flow of a fluid. More specifically, the present disclosure relates to the system and the method for controlling the flow of a cryogenic fluid.

BACKGROUND

Generally, critical components of machines may be cooled using cryogenic systems. In such systems, a cryogenic fluid is used to cool the components in which temperature is controlled by allowing the cryogenic fluid to boil and vaporize at a saturation temperature. In some systems, the same cryogenic fluid may then be required to cool another downstream component or may be stored. In some situations, the downstream component or the storage may require the cryogenic fluid to be in liquid state due to process requirements. In such a situation, the vaporized cryogenic fluid may need to be cooled and converted to liquid state before reaching the downstream component or being stored. This in turn requires additional systems to cool the vaporized cryogenic fluid increasing system cost, maintenance cost and/or lowering system efficiency. Also, a flow rate of the cryogenic fluid may have to be accurately controlled for providing desired temperate control of the components. As a result, additional flow control systems may have to be employed in the system increasing system and/or maintenance cost.

U.S. Pat. No. 7,054,764 describes a method of determining a flow rate of a fluid having a liquid fraction and a gas fraction. The method includes measuring a pressure and temperature of the fluid at a flow control device through which the fluid passes. The method includes inputting the measured pressure and flow coefficient (Cv) into an algorithm. The method also includes performing a single or multi-step iteration to determine a fluid mass flow rate of the fluid through the flow control device using the algorithm. The algorithm relates the mass flow rate of the fluid to the Cv, and mass densities of the liquid fraction and the gas fraction of the fluid which are a function of the measured pressure and temperature.

Some flow control systems measure the flow rate of the cryogenic fluid before and after the cooled component. However, such systems may require high accuracy cryogenically compatible equipment and a controller to accurately control the flow of the cryogenic fluid. Hence, there is a need for an improved system and method for controlling the flow of the cryogenic fluid.

SUMMARY OF THE DISCLOSURE

In an aspect of the present disclosure, a flow control system for a flow of a cryogenic fluid over a component is provided. The flow control system includes a first tubing containing a first fluid therein. The first tubing is configured to be positioned upstream of the component with respect to the flow of the cryogenic fluid. The first fluid is fluidly disconnected from the cryogenic fluid and a chemical composition of the first fluid is same as a chemical composition of the cryogenic fluid. The flow control system includes a second tubing containing a second fluid therein. The second tubing is configured to be positioned downstream of the component with respect to the flow of the cryogenic fluid.

The second fluid is fluidly disconnected from the first fluid and the cryogenic fluid. A chemical composition of the second fluid is same as the chemical composition of the cryogenic fluid. The flow control system also includes a parameter sensing device configured to be fluidly connected to the first tubing and the second tubing. The parameter sensing device is configured to compare a first parameter associated with the first tubing and a second parameter associated with the second tubing. The flow control system further includes a flow control device configured to be coupled to the parameter sensing device. The flow control device is configured to regulate the flow of the cryogenic fluid over the component based, at least in part, on the comparison.

In another aspect of the present disclosure, a method for controlling a flow of a cryogenic fluid over a component is provided. The method includes positioning a first tubing containing a first fluid therein upstream of the component with respect to the flow of the cryogenic fluid. The first fluid is fluidly disconnected from the cryogenic fluid and a chemical composition of the first fluid is same as a chemical composition of the cryogenic fluid. The method includes positioning a second tubing containing a second fluid therein downstream of the component with respect to the flow of the cryogenic fluid. The second fluid is fluidly disconnected from the first fluid and the cryogenic fluid. A chemical composition of the second fluid is same as the chemical composition of the cryogenic fluid. The method also includes comparing a first parameter associated with the first tubing with a second parameter associated with the second tubing by the parameter sensing device. The method further includes regulating the flow of the cryogenic fluid over the component through a flow control device, wherein the regulation is based, at least in part, on the comparison.

In yet another aspect of the present disclosure, a system is provided. The system includes a component configured to receive a flow of a cryogenic fluid thereover. The system includes a first tubing positioned upstream of the component with respect to the flow of the cryogenic fluid and immersed into the flow of the cryogenic fluid. The first tubing contains a first fluid therein. The first fluid is fluidly disconnected from the cryogenic fluid and a chemical composition of the first fluid is same as a chemical composition of the cryogenic fluid. The system includes a second tubing positioned downstream of the component with respect to the flow of the cryogenic fluid and immersed into the flow of the cryogenic fluid. The second tubing contains a second fluid therein. The second fluid is fluidly disconnected from the first fluid and the cryogenic fluid. A chemical composition of the second fluid is same as the chemical composition of the cryogenic fluid. The system also includes a parameter sensing device fluidly connected to the first tubing and the second tubing. The parameter sensing device is configured to compare a first parameter associated with the first tubing and a second parameter associated with the second tubing. The system further includes a flow control device coupled to the parameter sensing device. The flow control device is configured to regulate the flow of the cryogenic fluid over the component based, at least in part, on the comparison.

Other features and aspects of this disclosure will be apparent from the following description and the accompanying drawings.

DETAILED DESCRIPTION

Figure 1:
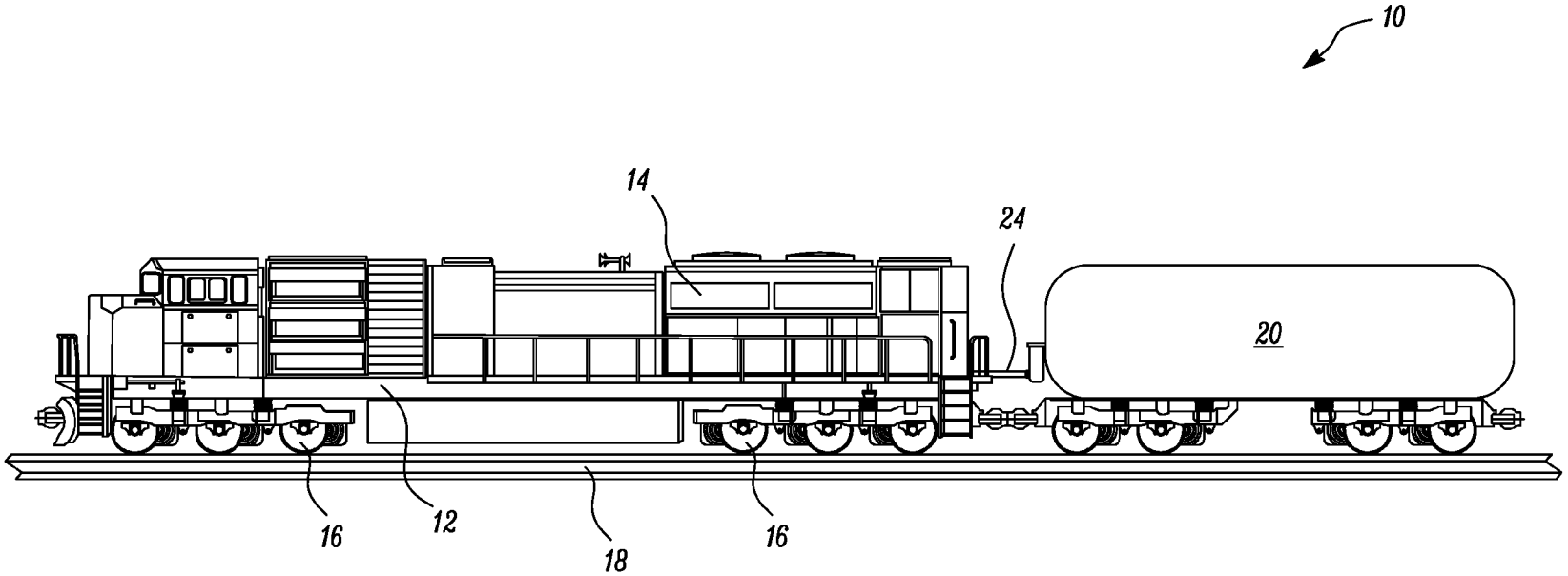
FIG. 1 is a side view of an exemplary machine, according to one embodiment of the present disclosure.

Wherever possible, the same reference numbers will be used throughout the drawings to refer to the same or the like parts. Referring to FIG. 1, an exemplary machine 10 is illustrated. More specifically, the machine 10 is a locomotive powered by a liquid fuel. In other embodiments, the machine 10 may be any machine powered by the liquid fuel. The liquid fuel may be any cryogenic fluid such as Liquefied Natural Gas (LNG). The machine 10 may be any machine related to an industry including, but not limited to, transportation, construction, aviation, aerospace, and marine.

The machine 10 includes a frame 12. The frame 12 is configured to support various components of the machine 10. The machine 10 includes an enclosure 14. The enclosure 14 is configured to house various components and systems (not shown) of the machine 10 such as an engine system, a drive system, an electrical system, a cooling system, a fuel supply system, an air supply system, a control system, a safety system, and so on. The machine 10 also includes a set of wheels 16 coupled to the frame 12. The wheels 16 are configured to support and provide mobility to the machine 10 on rails 18. The machine 10 also includes a fuel tank 20 coupled to the machine 10. The fuel tank 20 is configured to store the liquid fuel under cryogenic conditions. The fuel tank 20 is also fluidly coupled to a fuel supply system 22 of the machine 10 via a hose 24.

Figure 2:
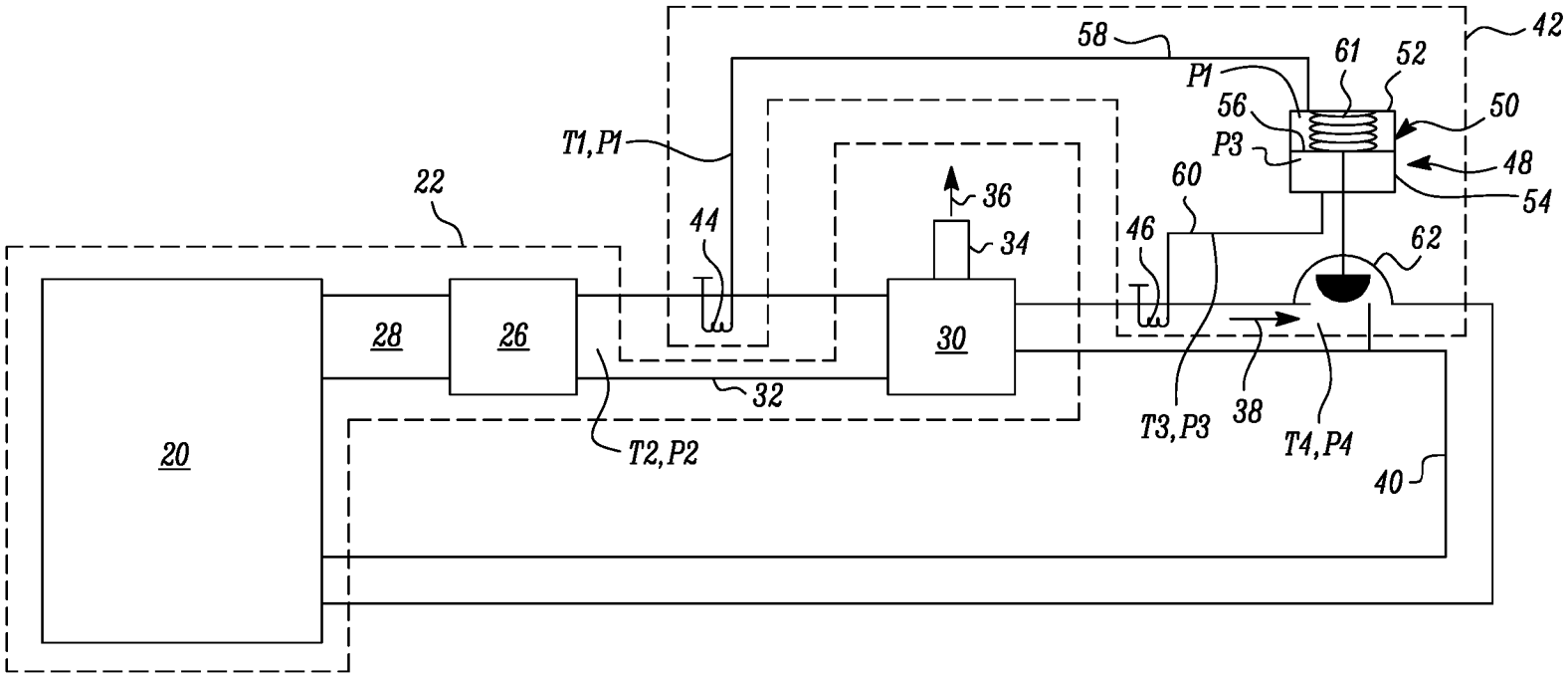
FIG. 2 is a block diagram of a flow control system for a cryogenic fluid, according to one embodiment of the present disclosure.

Referring to FIG. 2, the machine 10 includes the fuel supply system 22. More specifically, the fuel supply system 22 includes the fuel tank 20. The fuel supply system 22 includes a booster pump 26 fluidly coupled to the fuel tank 20. The booster pump 26 is fluidly coupled to the fuel tank 20 via a first conduit 28. The first conduit 28 is configured to provide a passage for a flow of the fuel from the fuel tank 20 to the booster pump 26. The first conduit 28 may be a hose, a pipe, and so on configured for cryogenic applications. The booster pump 26 may be any pump known in the art such as a centrifugal pump configured for cryogenic applications. In some embodiments, the booster pump 26 may be located within the fuel tank 20 and submerged within the fuel. In such a situation, the first conduit 28 may be omitted. The booster pump 26 is configured to receive the fuel from the fuel tank 20 and pressurize the fuel.

The fuel supply system 22 includes a High Pressure Stage Pump (HPSP) 30. The HPSP 30 is fluidly coupled to the booster pump 26 via a second conduit 32. The second conduit 32 is configured to provide a passage for a flow of the fuel from the booster pump 26 to the HPSP 30. The second conduit 32 may be a hose, a pipe, and so on configured for cryogenic applications. The HPSP 30 may be any pump known in the art such as, for example, a positive displacement piston pump configured for cryogenic applications. The HPSP 30 is configured to pressurize the fuel received from the booster pump 26 to a pressure higher than that received from the booster pump 26.

The HPSP 30 is further fluidly coupled to a fuel injection system (not shown) via a third conduit 34. The third conduit 34 is configured to provide a passage for a flow of a portion of the fuel, hereinafter referred to as a first flow 36 of the fuel from the HPSP 30 to the fuel injection system. The fuel injection system is configured to supply the first flow 36 of the fuel to the engine system. The fuel injection system may be any fuel injection system known in the art having one or more injectors, fuel lines, rail, valves, pumps, sensors, and so on configured for cryogenic applications.

During operation, an operating temperature of the HPSP 30 may be increased to undesired levels. An increase in the operating temperature of the HPSP 30 may in turn result in an unacceptable change in running clearances resulting in loss of pump performance and efficiency. In order to cool the HPSP 30 and maintain the HPSP 30 at a desired temperature, a remaining flow of the fuel, hereinafter referred to as a second flow 38 of the fuel from the HPSP 30 is recirculated over and/or within the HPSP 30 for cooling the HPSP 30. Further, the HPSP 30 is fluidly coupled to the fuel tank 20 via a fourth conduit 40. The fourth conduit 40 is configured to provide a passage for a flow of the second flow 38 of the fuel from the HPSP 30 to the fuel tank 20. The fourth conduit 40 may be a hose, a pipe, and so on configured for cryogenic applications.

Additionally, the machine 10 includes a flow control system 42. The flow control system 42 is provided in association with the fuel supply system 22. The flow control system 42 is configured to control the flow of the second flow 38 of the fuel over and/or within the HPSP 30 and further from the HPSP 30 to the fuel tank 20. The flow control system 42 includes a first tubing 44. The first tubing 44 is positioned upstream of the HPSP 30 with respect to the flow of the fuel. More specifically, the first tubing 44 is positioned within the second conduit 32 immersed within and in contact with the fuel flowing therein. The first tubing 44 may be made of any metal known in the art such as steel configured for cryogenic applications. The first tubing 44 may be in the form of a coil, a bulb, a probe, and so on.

The first tubing 44 includes a first fluid. The first fluid is contained within the first tubing 44 such that the first fluid is fluidly disconnected from the fuel flowing through the second conduit 32 at all times. More specifically, a chemical composition of the first fluid is same as that of the fuel flowing through the second conduit 32. In the illustrated embodiment, as the fuel is LNG, the first fluid is methane. The first fluid is contained in the first tubing 44 at a pressure P1 which is higher than a saturation pressure of the fuel flowing through the second conduit 32. In other embodiments, the first fluid may be any other cryogenic fluid such as liquid nitrogen, liquid helium, and so on. In such a situation the first fluid includes the same composition as the fluid in the second conduit 32.

During operation, as the first tubing 44 is in direct contact with the fuel flowing through the second conduit 32, a temperature T1 of the first fluid corresponds to a temperature T2 of the fuel flowing through the second conduit 32. As the first tubing 44 is surrounded by the fuel flowing in the second conduit 32, the temperature T1 of the first fluid may reduce until the temperature T1 of the first fluid matches the temperature T2 of the fuel flowing through the second conduit 32. A portion of the first fluid may condense into a cryogenic liquid within the first tubing 44. As a result, the pressure P1 of the first fluid matches a saturation pressure of the first fluid corresponding to the temperature T1 of the first fluid. The difference in the pressure P2 of the fuel over the pressure P1 of the first fluid may then be interpreted to be a pressure head above a boiling pressure of the fuel.

The flow control system 42 includes a second tubing 46. The second tubing 46 is positioned downstream of the HPSP 30 with respect to the flow of the fuel. More specifically, the second tubing 46 is positioned within the fourth conduit 40 immersed within and in contact with the second flow 38 of the fuel flowing therein. The second tubing 46 may be made of any metal known in the art, for example, steel, configured for cryogenic applications. The second tubing 46 may be in the form of a coil, a bulb, a probe, and so on.

The second tubing 46 includes a second fluid. The second fluid is contained within the second tubing 46 such that the second fluid is fluidly disconnected from the second flow 38 of the fuel flowing through the fourth conduit 40 and the first tubing 44 at all times. More specifically, a chemical composition of the second fluid is same as that of the second flow 38 of the fuel flowing through the fourth conduit 40. In the illustrated embodiment, as the fuel is LNG, the second fluid is methane. The second fluid is contained in the second tubing 46 at a pressure P3 which is higher than a saturation pressure of the second flow 38 of the fuel flowing through the fourth conduit 40. In other embodiments, the second fluid may be any other cryogenic fluid such as liquid nitrogen, liquid helium, and so on. In such a situation the second fluid includes the same composition as the fluid in the fourth conduit 40.

During operation, as the second tubing 46 is in direct contact with the second flow 38 of the fuel flowing through the fourth conduit 40, a temperature T3 of the second fluid corresponds to a temperature T4 of the second flow 38 of the fuel. As the second tubing 46 is surrounded by the second flow 38 of the fuel flowing in the fourth conduit 40, the temperature T3 of the second fluid may reduce until the temperature T3 of the second fluid matches the temperature T4 of the second flow 38 of the fuel flowing through the fourth conduit 40. A portion of the second fluid may condense into a cryogenic liquid within the second tubing 46. As a result, the pressure P3 of the second fluid matches a saturation pressure of the second fluid corresponding to the temperature T1 of the second fluid. The difference in the pressure P4 of the second flow 38 of the fuel over the pressure P3 of the second fluid may then be interpreted to be a pressure head above a boiling pressure of the second flow 38 of the fuel.

The flow control system 42 also includes a parameter sensing device 48. In the illustrated embodiment, the parameter sensing device 48 is a diaphragm based parameter sensing device. In other embodiments, the parameter sensing device 48 may be any parameter sensing device such as a spring based parameter sensing device, weight based parameter sensing device, a gas based parameter sensing device, and so on configured for cryogenic applications.

The parameter sensing device 48 includes a housing 50 having a first side 52 and a second side 54. The parameter sensing device 48 includes a diaphragm 56 positioned between the first side 52 and the second side 54. The parameter sensing device 48 is fluidly coupled to the first tubing 44 and the second tubing 46. More specifically, the first tubing 44 is fluidly coupled to the first side 52 via a first fluid line 58. The second tubing 46 is fluidly coupled to the second side 54 via a second fluid line 60.

The parameter sensing device 48 includes a biasing component 61. The biasing component 61 is coupled to the diaphragm 56. In the illustrated embodiment, the biasing component 61 is provided within the first side 52 of the parameter sensing device 48. In other embodiments, the biasing component 61 may be provided within the second side 54 of the parameter sensing device 48. More specifically, the biasing component 61 increases a sensitivity of the parameter sensing device 48 to the pressure P1 of the first fluid and decreases the sensitivity of the parameter sensing device 48 to the pressure P3 of the second fluid. The biasing component 61 causes the diaphragm 56 to be biased towards the second side 54 and away from the first side 52 in an equilibrium position. The biasing component 61 may be a spring, a weight, a gas bladder, and so on.

The parameter sensing device 48 is configured to compare a first parameter associated with the first tubing 44 and a second parameter associated with the second tubing 46. In the illustrated embodiment, the first parameter is the pressure P1 of the first fluid. Also, the second parameter is the pressure P3 of the second fluid. More specifically, the parameter sensing device 48 is configured to sense a difference between the pressure P1 of the first fluid and the pressure P3 of the second fluid.

The flow control system 42 further includes a flow control device 62. The flow control device 62 is coupled to the parameter sensing device 48. The flow control device 62 is configured to regulate the second flow 38 of the fuel over the HPSP 30 and further to the fuel tank 20 based on the comparison. More specifically, based on a pressure differential between the first side 52 and the second side 54 of the parameter sensing device 48, a position of the diaphragm 56 may vary. Based on the position of the diaphragm 56, the flow control device 62 may be operated to either reduce or increase the second flow 38 of the fuel through the flow control device 62.

During operation, when the pressure P1 of the first fluid in the first tubing 44 is lower than the pressure P3 of the second fluid in the second tubing 46, the diaphragm 56 overcomes the biasing component 61, moving the diaphragm 56 towards the first side 52. As a result, the flow control device 62 may open to allow and/or increase the second flow 38 of the fuel to the fuel tank 20. Alternatively, when the pressure P1 of the first fluid in the first tubing 44 is higher than or equal to the pressure P3 of the second fluid in the second tubing 46 in addition to the offset caused by the biasing device 64, the diaphragm 56 is further biased towards the second side 54. As a result, the flow control device 62 may close to prevent and/or reduce the flow of the second flow 38 of the fuel to the fuel tank 20. The flow control device 62 may be any valve known in the art such as a variable orifice valve, a globe valve, a ball valve, a slide valve, and so on configured for cryogenic applications.

INDUSTRIAL APPLICABILITY

Figure 3:
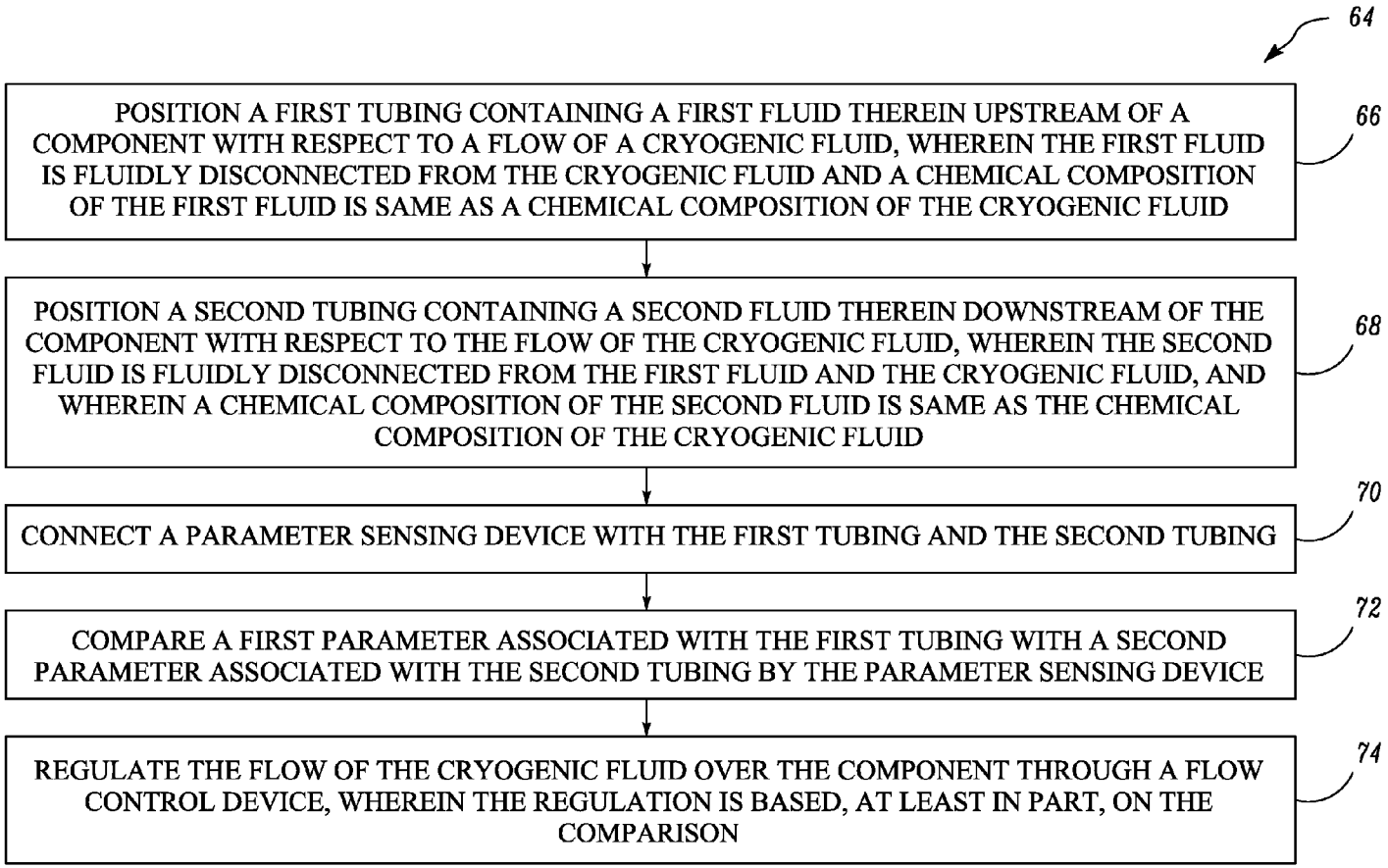
FIG. 3 is a flowchart of a method for controlling a flow of the cryogenic fluid, according to one embodiment of the present disclosure.

The present disclosure relates to the flow control system 42. Referring to FIG. 3, a method 64 for controlling the second flow 38 of the fuel over and/or within the HPSP 30 and further to the fuel tank 20 is illustrated. At step 66, the first tubing 44 containing the first fluid therein is positioned within the second conduit 32. The first fluid contained in the first tubing 44 is fluidly disconnected from the flow of the fuel in the second conduit 32. More specifically, the first tubing 44 is positioned upstream of the HPSP 30 with respect to the flow of the fuel and immersed therein. As a result the temperature T1 of the first fluid may reduce until the temperature T1 of the first fluid matches the temperature T2 of the fuel in the second conduit 32. The portion of the first fluid may condense into the cryogenic liquid within the first tubing 44, reducing the pressure P1 of the first fluid until the pressure P1 of the first fluid matches the saturation pressure of the first fluid corresponding to the temperature T1 of the first fluid.

At step 68, the second tubing 46 containing the second fluid therein is positioned within the fourth conduit 40. The second fluid contained in the second tubing 46 is fluidly disconnected from the second flow 38 of the fuel in the fourth conduit 40 and the first tubing 44. More specifically, the second tubing 46 is positioned downstream of the HPSP 30 with respect to the second flow 38 of the fuel and immersed therein. As a result, the temperature T3 of the second fluid may reduce until the temperature T3 of the second fluid matches the temperature T4 of the second flow 38 of the fuel. The portion of the second fluid may condense into the cryogenic liquid within the second tubing 46, reducing the pressure P3 of the second fluid until the pressure P3 of the second fluid matches the saturation pressure of the second fluid corresponding to the temperature T3 of the second fluid.

At step 70, the parameter sensing device 48 is connected to the first tubing 44 and the second tubing 46. More specifically, the first side 52 of the parameter sensing device 48 is coupled to the first tubing 44 via the first fluid line 58. The second side 54 of the parameter sensing device 48 is coupled to the second tubing 46 via the second fluid line 60. As a result, the first side 52 may be subject to the pressure P1 of the first fluid and the second side 54 may be subject to the pressure P3 of the second fluid.

At step 72, the first parameter associated with the first fluid is compared with the second parameter associated with the second fluid. The comparison is based on sensing the difference between the first parameter and the second parameter. The first parameter is the pressure P1 of the first fluid. The second parameter is the pressure P3 of the second fluid. More specifically, the pressure P1 of the first fluid at the first side 52 combined with the increased sensitivity provided by the biasing device 61 is compared with the pressure P3 of the second fluid at the second side 54 combined with the decreased sensitivity provided by the biasing device 61 of the diaphragm 56.

At step 74, based on the comparison, the second flow 38 of the fuel over and/or within the HPSP 30 is regulated by the flow control device 62. More specifically, during normal operating conditions, the temperature T2 and the pressure P2 of the fuel upstream of the HPSP 30 is lower than the temperature T4 and the pressure P4 of the second flow 38 of the fuel downstream of the HPSP 30. In situations when the operating temperature of the HPSP 30 may increase and/or flow rate of the second flow 38 of the fuel over and/or within the HPSP 30 may reduce, the temperature T4 and the pressure P4 of the second flow 38 of the fuel may increase up to the boiling point resulting in change of state of the second flow 38 of the fuel.

As a result, the temperature T3 and the pressure P3 of the second fluid may also increase correspondingly compared to the temperature T1 and the pressure P1 of the first fluid. Accordingly, the pressure P3 at the second side 54 of the parameter sensing device 48 increases, thus, overcoming the biasing device 61 and moving the diaphragm 56 towards the first side 52. As a result, the flow control device 62 actuates to increase the flow rate of the second flow 38 of the fuel therethrough and over and/or within the HPSP 30.

Due to increase in the flow rate, the temperature T4, T3 and the pressure P4, P3 of the second flow 38 of the fuel and that of the second fluid respectively may reduce below the boiling point. As a result, the pressure P3 in the second side 54 may reduce thus moving the diaphragm 56 to an equilibrium position. Accordingly, the flow control device 62 may actuate to reduce the flow rate of the second flow 38 of the fuel therethrough and over and/or within the HPSP 30 to normal operating conditions, thereby maintaining the second flow 38 of the fuel in liquid state.

The system and method described herein provide a cost effective, simple, and accurate solution for controlling the flow of the cryogenic fluid in the system. Further, the components of the system are easy to assemble and do not incur substantial hardware costs. It should be noted that the flow control system 42 and the method 64 for controlling the flow of the fuel may be used with any cryogenic system. For example, the flow control system 42 may be used for controlling the flow of the cryogenic fluid in systems or equipment related to any industry such as refrigeration, process industry, food industry, dairy industry, and so on and may not limit the scope of the disclosure.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A flow control system for a flow of a cryogenic fluid over a component, the flow control system comprising:

a first tubing containing a first fluid therein, the first tubing configured to be positioned upstream of the component with respect to the flow of the cryogenic fluid, wherein the first fluid is fluidly disconnected from the cryogenic fluid and a chemical composition of the first fluid is same as a chemical composition of the cryogenic fluid;

a second tubing containing a second fluid therein, the second tubing configured to be positioned downstream of the component with respect to the flow of the cryogenic fluid, wherein the second fluid is fluidly disconnected from the first fluid and the cryogenic fluid, and wherein a chemical composition of the second fluid is same as the chemical composition of the cryogenic fluid;

a parameter sensing device configured to be fluidly connected to the first tubing and the second tubing, the parameter sensing device configured to compare a first parameter associated with the first tubing and a second parameter associated with the second tubing; and a flow control device configured to be coupled to the parameter sensing device, the flow control device configured to regulate the flow of the cryogenic fluid over the component based, at least in part, on the comparison.

2. The flow control system of claim 1, wherein the parameter sensing device includes a diaphragm.

3. The flow control system of claim 2, wherein the first tubing is fluidly coupled to a first side of the diaphragm and the second tubing is fluidly coupled to second side of the diaphragm.

4. The flow control system of claim 1, wherein the first parameter includes a pressure of the first fluid within the first tubing.

5. The flow control system of claim 1, wherein the second parameter includes a pressure of the second fluid within the second tubing.

6. The flow control system of claim 1, wherein the flow control device includes a variable orifice.

7. The flow control system of claim 1, wherein the first tubing and the second tubing are configured to be immersed within the flow of the cryogenic fluid.

8. The flow control system of claim 1, wherein the parameter sensing device is configured to sense a difference between the first parameter associated with the first tubing and the second parameter associated with the second tubing.

9. The flow control system of claim 1, wherein the first tubing includes at least one of a coil and a bulb.

10. The flow control system of claim 1, wherein the second tubing includes at least one of a coil and a bulb.

11. A method for controlling a flow of a cryogenic fluid over a component, the method comprising:

positioning a first tubing containing a first fluid therein upstream of the component with respect to the flow of the cryogenic fluid, wherein the first fluid is fluidly disconnected from the cryogenic fluid and a chemical composition of the first fluid is same as a chemical composition of the cryogenic fluid;

positioning a second tubing containing a second fluid therein downstream of the component with respect to the flow of the cryogenic fluid, wherein the second fluid is fluidly disconnected from the first fluid and the cryogenic fluid, and wherein a chemical composition of the second fluid is same as the chemical composition of the cryogenic fluid;

connecting a parameter sensing device with the first tubing and the second tubing;

comparing a first parameter associated with the first tubing with a second parameter associated with the second tubing by the parameter sensing device; and regulating the flow of the cryogenic fluid over the component through a flow control device, wherein the regulation is based, at least in part, on the comparison.

12. The method of claim 11, wherein the first parameter includes a pressure of the first fluid within the first tubing.

13. The method of claim 11, wherein the second parameter includes a pressure of the second fluid within the second tubing.

14. The method of claim 11 further comprising immersing the first tubing and the second tubing in the flow of the cryogenic fluid.

15. The method of claim 11, wherein the comparing step further includes sensing a difference between the first parameter associated with the first tubing and the second parameter associated with the second tubing.

16. A system comprising:

a component configured to receive a flow of a cryogenic fluid thereover;

a first tubing positioned upstream of the component with respect to the flow of the cryogenic fluid and immersed into the flow of the cryogenic fluid, the first tubing containing a first fluid therein, wherein the first fluid is fluidly disconnected from the cryogenic fluid and a chemical composition of the first fluid is same as a chemical composition of the cryogenic fluid;

a second tubing positioned downstream of the component with respect to the flow of the cryogenic fluid and immersed into the flow of the cryogenic fluid, the second tubing containing a second fluid therein, wherein the second fluid is fluidly disconnected from the first fluid and the cryogenic fluid, and wherein a chemical composition of the second fluid is same as the chemical composition of the cryogenic fluid;

a parameter sensing device fluidly connected to the first tubing and the second tubing, the parameter sensing device configured to compare a first parameter associated with the first tubing and a second parameter associated with the second tubing; and a flow control device coupled to the parameter sensing device, the flow control device configured to regulate the flow of the cryogenic fluid over the component based, at least in part, on the comparison.

17. The system of claim 16, wherein the parameter sensing device includes a diaphragm.

18. The system of claim 17, wherein the first tubing is fluidly coupled to a first side of the diaphragm and the second tubing is fluidly coupled to second side of the diaphragm.

19. The system of claim 16, wherein the first parameter includes a pressure of the first fluid within the first tubing.

20. The system of claim 16, wherein the second parameter includes a pressure of the second fluid within the second tubing.

* * * * *